US006093078A

United States Patent [19]

Cook

[11] Patent Number: 6,093,078

[45] Date of Patent: Jul. 25, 2000

[54] HAND HELD DOLL SIMULATING SKATING ACTION

[75] Inventor: Robynn M. Cook, Aliso Viejo, Calif.

[73] Assignee: Mattel, Inc., El Segundo

[21] Appl. No.: 09/244,609

[22] Filed: Feb. 4, 1999

[51] Int. Cl.[7] ..... A63H 13/12; A63H 3/20

[52] U.S. Cl. ..... 446/354; 446/330; 446/338

[58] Field of Search ..... 446/330, 331, 446/334–336, 338, 352, 354, 365; 40/419

[56] References Cited

U.S. PATENT DOCUMENTS

| | | | |
|---|---|---|---|
| 3,599,364 | 8/1971 | Garcia . | |
| 3,660,931 | 5/1972 | Gardel et al. . | |
| 3,672,097 | 6/1972 | Gerdel et al. . | |
| 3,724,125 | 4/1973 | Goldfarb et al. . | |
| 3,728,816 | 4/1973 | Ensmann et al. . | |
| 3,769,745 | 11/1973 | Crosman . | |
| 3,775,900 | 12/1973 | Thorn et al. . | |
| 3,955,311 | 5/1976 | Lyons et al. . | |
| 4,003,158 | 1/1977 | Wolf et al. . | |
| 4,126,961 | 11/1978 | Barlow et al. . | |
| 4,305,222 | 12/1981 | Terzian et al. . | |
| 4,467,555 | 8/1984 | Terzian et al. | 446/158 |
| 4,559,021 | 12/1985 | Wittenberg et al. . | |
| 4,595,379 | 6/1986 | Rasmussen et al. | 446/341 |
| 4,608,026 | 8/1986 | Newton et al. . | |
| 5,042,807 | 8/1991 | Sasakawa et al. | 273/85 C |
| 5,087,219 | 2/1992 | Price . | |

*Primary Examiner*—Robert A. Hafer
*Assistant Examiner*—Laura Fossum
*Attorney, Agent, or Firm*—Roy A. Ekstrand

[57] ABSTRACT

A doll includes a torso supporting a pair of legs each having a simulated skate supported of the lower end thereof. The torso further supports a head which is coupled to a neck portion of the doll by a freely pivoting coupler. A housing within the doll torso supports a pivoting yoke coupled to a gear and rack drive mechanism. The gear rack is coupled to a depressible push button which the user actuates by squeezing the doll torso. A pair of arms are pivotally supported upon the torso and coupled to a gear drive mechanism responsive to the push button to move the arms back-and-forth in opposite pivotal directions as the push button repetitively squeezed and released.

11 Claims, 2 Drawing Sheets

HAND HELD DOLL SIMULATING SKATING ACTION

FIELD OF THE INVENTION

This invention relates generally to articulated dolls and particularly to those employing a manually activated movement feature.

BACKGROUND OF THE INVENTION

Toy dolls are a long lasting and well known segment of the toy industry. Such dolls have enjoyed a virtually uninterrupted popularity among child users from earliest times to the present and give every appearance of continuing into the future. As a result of this sustained long term popularity, practitioners in the art have endeavored to provide a virtually endless variety of dolls. Thus doll have been provide which vary from large "life size" dolls to small fashion dolls. Further variation is found in the material of dolls varying from soft so-called "plush" dolls to hard plastic dolls and doll figures. The overall appearance theme has enjoyed corresponding variety extending from life-like realistic dolls to fanciful and cartoon-like dolls. By way of further variation, dolls have been provided that vary from passive dolls which lack any operative mechanism or feature to dolls which are extremely active and able to perform various movements or activities. Active dolls generally utilize some power source such as a spring driven wind-up motor or a battery powered electric motor mechanism. Still other dolls which are active, utilize a hand-powered mechanism for providing the necessary energy for doll activity. For example, U.S. Pat. No. 3,724,125 issued to Goldfarb et al. sets forth a PUSH BUTTON DOLL having a body supporting a plurality of limbs and a spring loaded button accessible from the front of the doll. Means individually connect each of the limbs and head of the doll to the button such that the limbs and head move in response to depression of the button.

U.S. Pat. No. 4,126,961 issued to Barlow et al. sets forth a ARTICULATED DOLL having a torso and head mounted upon the torso. A universal connection is utilized to secure the head which permits nodding, twisting and universal movement of the head relative to the torso. A singular manually manipulatable mechanism is mounted on the torso for movement of the head through a linkage system.

U.S. Pat. No. 3,728,816 issued to Ensmenn et al. sets forth a CLAMORING DOLL having a spring motor and drive train to animate the arms and head of the doll. The arms are pivoted for a up and down motion and the drive train includes a spring loaded yoke connected to drive the arms through the required arcuate displacement.

U.S. Pat. No. 4,559,021 issued to Wittenberg et al. sets forth a POSEABLE HEAD DOLL having a base resembling the upper torso and shoulders of a human-like figure together with a head rotatable supported upon the neck portion of the base. Drive means within the base are operative to pivot and pose the doll head.

U.S. Pat. No. 3,769,745 issued to Crosman sets forth a TEARING DOLL WITH ROTATABLE HEAD includes a resilient reservoir supporting a liquid such as water within the doll operatively coupled to tear ducts in the dolls eyes which is operated as the dolls head is turned to simulate crying.

U.S. Pat. No. 3,955,311 issued to Lyons sets forth a MECHANISM FOR MOVING AN UPPER APPENDAGE OF A TOY FIGURE having a push button on the upper side of the figures torso which is hand operated. By pushing the button motion is transmitted to a lever which is rotated upwardly. The upward motion of the lever is translated into rotary motion of a ball joint connected to an upper arm of the figure.

U.S. Pat. No. 4,003,158 issued to Wolf et al. sets forth a FIGHTING DOLL having an upper torso rotatably secured to a lower torso. Actuating means within the doll cause the upper torso to pivot relative to the lower torso. The doll further includes a pair of freely moveable arms secured to the torso. The relative movement of the upper torso swings the arms to provide movement thereof.

U.S. Pat. No. 4,608,026 issued to Newton et al. sets forth a FIGURE WHEREIN MANIPULATION OF ONE LIMB CAUSES MOTION OF ANOTHER having a torso supporting downwardly extending legs and outwardly extending arms. The legs are pivotable toward and away from each other and are coupled to a mechanism which converts movement of one of the legs into arm motion using a squeeze and release play pattern.

U.S. Pat. No. 5,087,219 issued to Price sets forth a ACTION CHARACTER FIGURE having a torso portion, a rotatable arm portion on the torso portion and a leg portion which is retractable into the lower end of the torso portion. The arm is connected to the leg portion such that rotation of the arm causes the leg portion to be retracted into the torso portion against the force of an internal spring.

While the foregoing described prior art dolls have improved the art and in some instances enjoyed commercial success, there remains nonetheless a continuing need in the art for ever more interesting, amusing and entertaining hand held type dolls.

SUMMARY OF THE INVENTION

Accordingly, it is a object of the present invention to provide an improved hand held doll. It is a more particular object of the present invention to provide an improved hand held doll which includes an action figure allowing a skating type activity to be undertaken.

In accordance with the present invention there is provided a hand held doll comprising: a torso having a pair of arms pivotally supported thereon, a head, a pair of legs extending downwardly therefrom, a neck portion pivotally supporting the head, and an interior cavity; a coupler supported by the head; and a drive mechanism having a housing received within the interior cavity and a movable button, the drive mechanism including a gear rack movable with and joined to the button, a return spring urging the button outwardly, gear means rotatably engaging the gear coupled to the arms to pivot the arms and lever means coupled to the gear rack and the coupler, the button being alternately pushed and released to cause the head to be moved side-to-side and the arms to move front-to-back.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
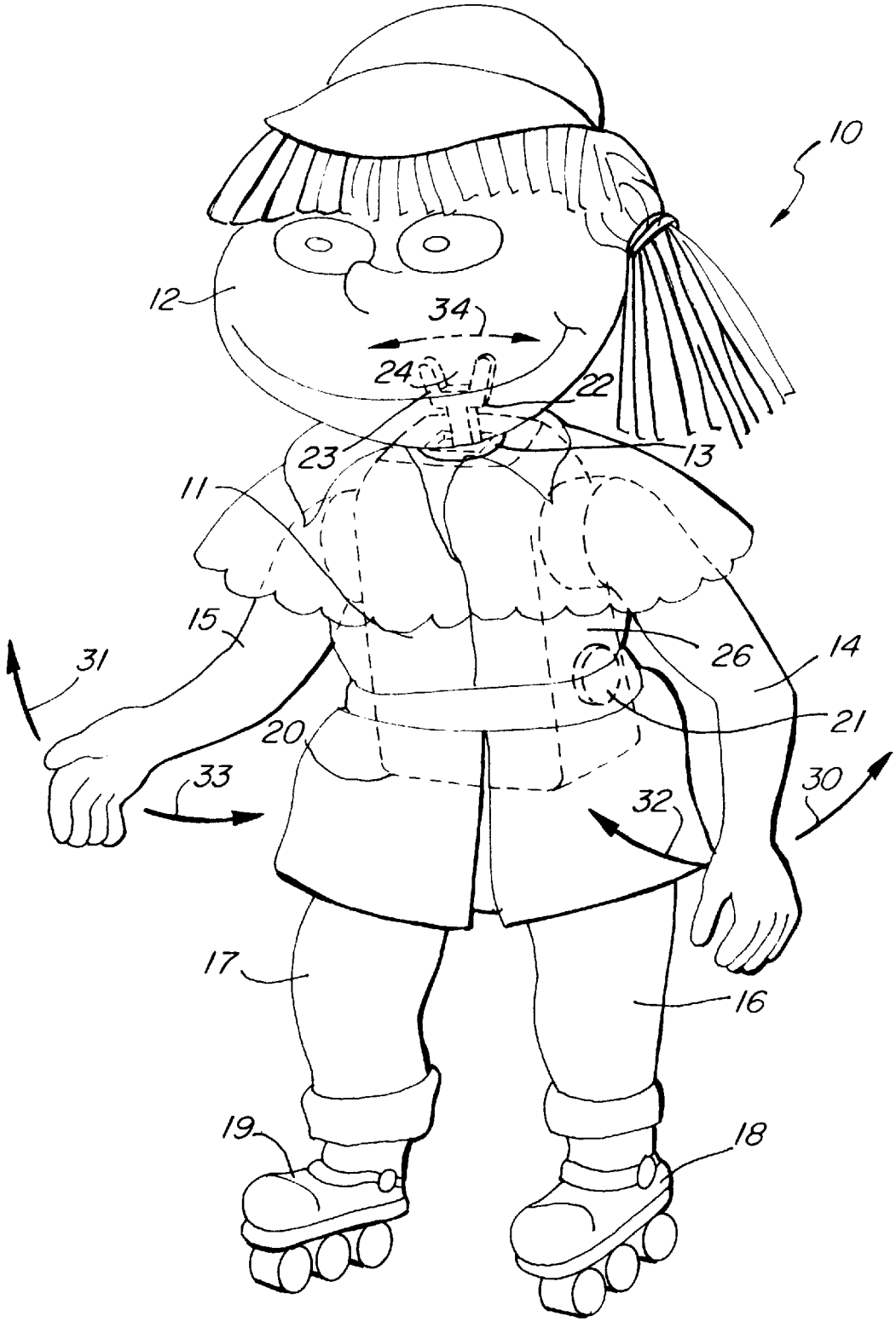
FIG. 1 sets forth a front perspective view of a hand held doll simulating skating action constructed in accordance with the present invention.

FIG. 1 sets forth a front perspective view of a hand held doll constructed in accordance with the present invention and generally referenced by numeral 10. Doll 10 includes a torso 11 having a neck 13 supporting a head 12. Torso 11 further supports a pair of arms 14 and 15 and a pair of legs 16 and 17. Legs 16 and 17 support a pair of skates 18 and 19 respectively.

In accordance with the present invention, a housing 20 is supported within a torso 11 and includes a push button 21. Housing 20 further supports a vertically extending yoke 22 having a fork 23 on the upper end of yoke 22 which in turn defines a gap 24. As is set forth below in greater detail, the internal mechanism within housing 20 which is operated by push button 21 moves yoke 22 and head 12 from side-to-side as indicated by arrows 34. In addition, the action of pushing and releasing push button 21 causes arms 14 and 15 to pivot back-and-forth in opposite directions as indicated by arrows 30 through 33. Thus, as arm 14 pivots rearwardly in the direction indicated by arrow 30, arm 15 pivots forwardly in the direction indicated by arrow 31. Conversely, as arm 14 pivots forwardly in the direction indicated by arrow 32, arm 15 pivots rearwardly in the direction indicated by arrow 33.

The operative mechanism within housing 20 is set forth below in FIG. 2 in greater detail. However, suffice it to note here that the operative mechanism within housing 20 responds to the action of pushing and releasing button 21 on the part of the user to move arms 14 and 15 in pivotal motion about their respective shoulder attachment and to move head 12 back-and-forth as indicated by arrows 34 through a pivotal motion of yoke 22. Thus in operation, the user is able to grasp torso 11 with a hand grip facilitating pressing and releasing button 21. Button 21 is supported beneath a flexible garment 26 formed of a flexible cloth or fabric or the like. Thus as the user squeezes and relaxes the grip upon torso 11, push button 21 is repeatedly depressed and released giving rise to the above described arm motion and head motion characteristic of a skating action.

Legs 16 and 17 of doll 10 are not operatively coupled to housing 20 and are passive. Preferably legs 16 and 17 are somewhat pivotal in their attachment to torso 11 such that the user is able to induce motion of legs 16 and 17 as the user moves doll 10 across the play surface. Of importance with respect to the present invention, however, the atainment of doll simulating a skating action without the prohibitly costly drive and support mechanisms required by prior art skating dolls. Doll 10 is included to meet the need for more interactive hand held dolls as opposed to more sophisticated and costly skating dolls which operate on their own. By providing a hand held doll to simulate skating action, which does not utilize the complex and expensive drive mechanism of conventional skating dolls, the present invention doll provides a hands-on feel together with increased play value and imagination on the part of the user.

Figure 2:
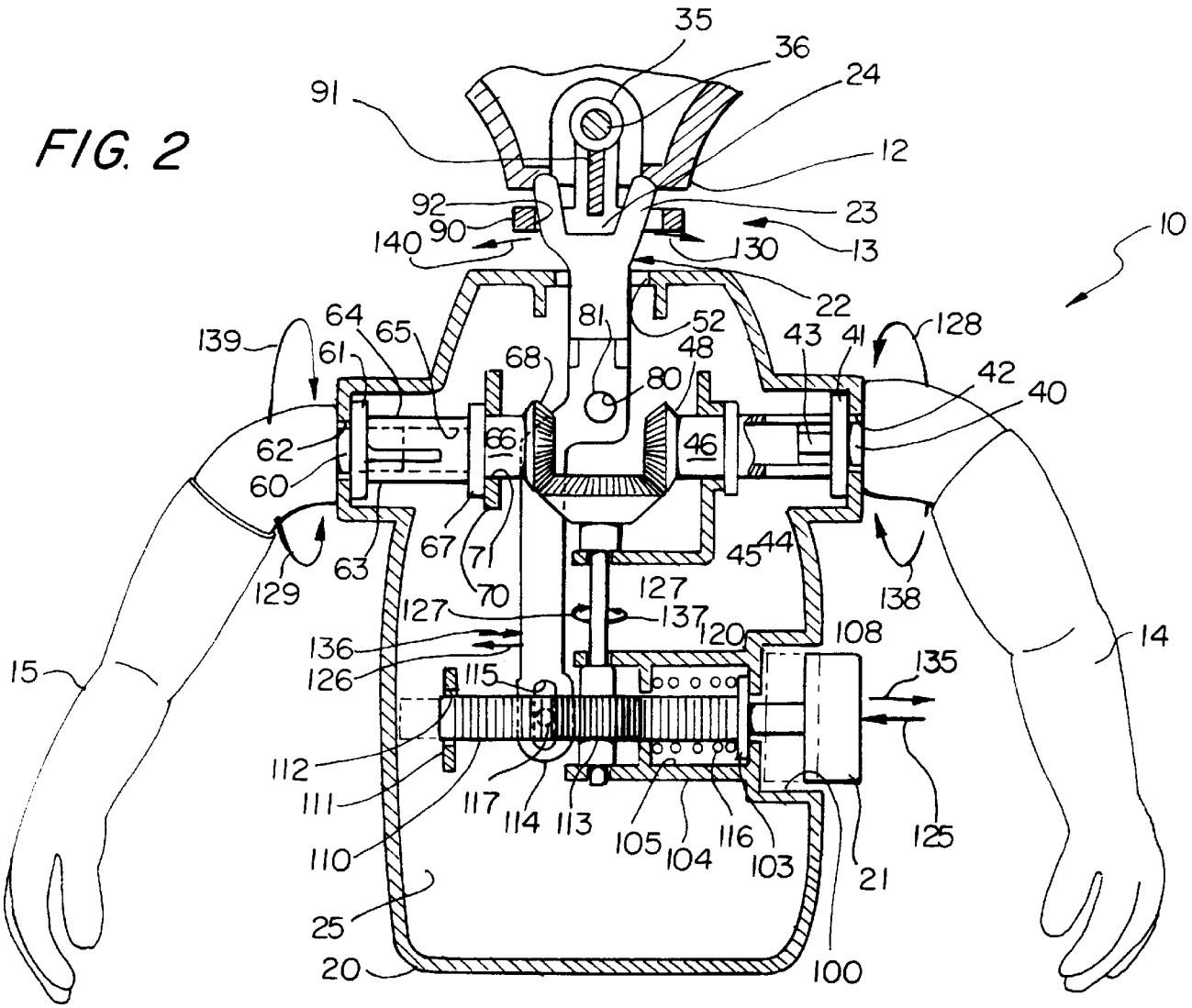
FIG. 2 sets forth a partial section view of the upper torso and operative mechanism of the present invention hand held doll simulating skating action.

FIG. 2 sets forth a partial section view of doll 10 showing the internal mechanism operative within housing 20. It will be recalled that housing 20 is supported within torso 11 of doll 10 in the manner shown above in FIG. 1. Housing 20 defines a recess 100 within with a push button 21 is moveable supported. Housing 20 further defines an aperture 101 and a drive housing 104 formed within an interior cavity 25 of housing 20. Drive housing 104 defines an internal passage 105 within which an aperture 108 is formed.

A shaft 102 extends inwardly from push button 21 through aperture 21 and is joined to a flange 103. Flange 103 is larger than aperture 101 captivating flange 103 within passage 105. A gear rack 110 is joined to flange 103 and extends through passage 105 and aperture 108 and beyond drive housing 104. Gear rack 110 also extends through aperture 112 formed in plate 11 within interior cavity 25. A generally cylindrical pin 117 extends downwardly from the undersurface of gear rack 110. A spring 116 captivated within passage 105 produces a spring force which urges flange 103 and shaft 102 outwardly to position push button 21 in the extended position shown in solid-line representation.

Yoke 22 defines a fork 23 having a center gap 24 formed therein. Yoke 22 defines an aperture 80 which is received upon a pivot post 81 formed in housing 20 within an interior cavity 25. Thus yoke 22, is pivotably supported upon post 81. Yoke 22 is elongated and includes a lower end 114 having an elongated slot 115 formed therein. End 114 of yoke 22 is positioned beneath gear rack 110 such that pin 117 thereof is received within slot 115.

A gear 113 is rotatably supported upon drive housing 104 in engagement with gear rack 110. A shaft 120 couples gear 113 to a bevel gear 121.

Bevel gear 121 engages a pair of bevel gears 48 and 68. Bevel gear 48 is rotatably supported by a baring 46 received within aperture 51 of plate 50. Plate 50 is supported within interior cavity 25 in accordance with conventional fabrication techniques. Baring 46 further includes a flange 47 having a diameter greater than aperture 51 of plate 50. A shaft 44 having an internal passage 45 extends outwardly from flange 47.

Arm 14 includes a baring 40 received within aperture 42 formed in housing 20. A flange 41 is integrally formed with baring 40 and further supports an inwardly extending hexagonal head 43. In the preferred fabrication of the present invention, passage 45 is configured to be received upon and engage head 43 such that the combined structures of baring 40, shaft 41, head 43, shaft 44, flange 47, baring 46 and bevel gear 48 rotate as a single rotational element.

In a similar fashion, bevel gear 48 is coupled to a baring 66 rotatably supported within an aperture 71 formed in a plate 70. Plate 70 is supported within interior cavity 25 in accordance with conventional fabrication techniques (not shown). Baring 66 further includes a flange 67 joined to a shaft 64. Shaft 64 defines a bore 65 received upon a head 63 of flange 61. A baring 60 is joined to flange 61 and arm 15 and is rotatable within aperture 62 of housing 20.

Head 12 is pivotally coupled to a coupler 90 by a pivot pin 96. Coupler 90 includes an aperture 92 receiving fork 23 of yoke 22. Coupler 90 further includes a downwardly extending rib 91 extending into gap 24 of fork 23. In accordance with the preferred fabrication of the present invention and the operation thereof described below in greater detail, the use of coupler 90 in association with head 12 and fork 23 provides a loose coupling therebetween which facilitates movement of head 12 under the urging of fork 23 while simultaneously providing a freely pivotal attachment for head 12. The result is an unusual head motion which is characteristic of a skater.

In operation, and assuming initially that no force is applied to push button 21, spring 116 forces flange 103 outwardly against aperture 101 thereby positioning push button 21 in the extended position shown in solid-line representation. Because gear rack 110 is joined to flange 103 gear rack 110 is positioned in the manner shown in solid-line representation. The action of doll 10 commences as the user applies a squeeze force to torso 11 (seen in FIG. 1) thereby exerting an inward force upon push button 21 in the direction indicated by arrow 125. When the squeeze force applied to push button 21 is sufficient to overcome the force of spring 116, the combined structure of push button 21, shaft 102, flange 103 and gear rack 110 is moved in a corresponding movement in the direction of arrow 125. This movement of gear rack 110 moves end 114 of yoke 22 in the direction indicated by arrow 126 due to the coupling of pin 117 into slot 115 thereof. With end 114 moved in the direction indicated by arrow 126, fork 23 of yoke 22 is pivoted about pivot post 81 in the direction indicated by arrow 130.

In addition of movement of yoke 22 to pivot head 12, the movement of gear rack 110 in the direction indicated by arrow 125 rotates gear 113 and shaft 120 in the direction indicated by arrow 127. As a result, bevel gear 121 is correspondingly rotated in the direction of arrow 127. The engagement of gear 48 against bevel gear 121 causes the rotation of gear 121 to rotate gear 48 together with baring 46, flange 47, shaft 44, head 43, flange 41, baring 40 and arm 14 in the direction indicated by arrow 128. Correspondingly, the rotation of bevel gear 121 rotates gear 68 causing the combined structure of gear 68, baring 66, flange 67, shaft 64, head 63, flange 61, baring 60 and arm 15 to rotate in the direction indicated by arrow 129. It will be noted that the rotation of arms 14 and 15 are in opposite directions due to the mutual couplings of gears 48 and 68 to bevel gear 121.

Once push button 21 has been fully depressed and released, the force of spring 116 urges the combined structure of flange 103, gear rack 110, shaft 102 and push button 21 outwardly in the direction indicated by arrow 135. This motion of gear rack 110 moves end 114 of yoke 22 in the direction indicated by arrow 136 while simultaneously rotating gear 113 in the direction indicated by arrow 137. The movement of end 114 in the direction of arrow 136 pivots yoke 22 about post 81 in the direction indicated by arrow 140 imparting an oppositely tilting motion to head 12 through coupler 90.

Simultaneously, as gear 113 is rotated in the direction indicated by arrow 137, shaft 120 and bevel gear 121 are correspondingly rotated. The rotation of bevel gear 121 in the direction indicated by arrow 137 results in rotation of gear 48 and arm 14 in the direction indicated by arrow 138. Similarly, rotation of bevel gear 121 in the direction indicated by arrow 137 rotates bevel gear 68 and arm 15 in the direction indicated by arrow 139.

Thus as can be seen, the repetitive squeezing and releasing of the doll torso producing repetitive depressing and releasing of push button 21 results in back-and-forth pivotal movement of head 12 and front-to-back offset pivotal movements of arms 14 and 15 about their respective shoulder attachments. The placements of push button 21 in the manner shown relative to torso 11 (seen in FIG. 1) is selected to facilitate a natural tendency for the user playing with doll 10 to grip the doll at the waist portion at its torso and move the doll along a play surface in a imaginary skating play activity. The realism of action provided by arm motion back-and-forth and head motion from side-to-side is recognizably characteristic of skating action and thus adds amusement and entertainment to the present invention doll. The mechanism provided is a simple hand held mechanism which avoid the high cost and complexity associated with skating dolls that are freely moveable and independently capable of skating. The hand held nature of the present invention doll provides the child user with a more interactive and challenging manipulation of the doll to provide a simulated skating action.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A hand held doll comprising:

a unitary torso having a pair of arms pivotally supported thereon, a head, a pair of legs extending downwardly therefrom, a neck portion pivotally supporting said head, and an interior cavity;

a coupler supported by said head; and a drive mechanism constructed to move said head and arms relative to said torso without moving said torso, said drive mechanism having a housing received within said interior cavity and a movable button, said drive mechanism including a gear rack movable with and joined to said button, a return spring urging said button outwardly, gear means rotatably engaging said gear rack coupled to said arms to pivot said arms and lever means coupled to said gear rack and said coupler for moving said head relative to said torso, said button being constructed to cause said head to be moved side-to-side relative to said torso without causing said torso to be moved and said arms to move front-to-back when said button is alternately pushed and released.

2. The hand held doll set forth in claim 1 wherein said gear means include:

a first gear and first shaft, said first gear engaging said gear rack;

a second gear coupled to said first shaft; and a third gear and forth gear each engaging said second gear and one of said arms in said pair of arms.

3. The hand held doll set forth in claim 2 wherein said lever means includes a yoke defining an upper end received within said coupler, a lower end engaging said gear rack and a pivotal support intermediate said upper and lower ends.

4. The hand held doll set forth in claim 3 wherein said lever means includes a slot formed in said lower end of said yoke and a post extending from said gear rack into said slot.

5. The hand held doll set forth in claim 4 wherein said coupler includes a center rib and wherein said upper end of said yoke includes a fork having a gap therein receiving said rib.

6. The hand held doll set forth in claim 5 wherein said first gear rotates said second and third gears in opposite directions.

7. The hand held doll set forth in claim 6 wherein said first, second and third gears are bevel gears.

8. The hand held doll set forth in claim 1 wherein said lever means includes a yoke defining an upper end received within said coupler, a lower end engaging said gear rack and a pivotal support intermediate said upper and lower ends.

9. The hand held doll set forth in claim 8 wherein said lever means includes a slot formed in said lower end of said yoke and a post extending from said gear rack into said slot.

10. The hand held doll set forth in claim 9 wherein said gear means include:

a first gear and first shaft, said first gear engaging said gear rack;

a second gear coupled to said first shaft; and a third gear and forth gear each engaging said second gear and one of said arms in said pair of arms.

11. The hand held doll set forth in claim 8 wherein said coupler includes a center rib and wherein said upper end of said yoke includes a fork having a gap therein receiving said rib.

* * * * *